US005221936A

United States Patent [19]

Saito et al.

[11] Patent Number: 5,221,936

[45] Date of Patent: Jun. 22, 1993

[54] INK TANK HAVING A VENT PATH OPENED AND CLOSED BY A MOVABLE MAGNETIC MEMBER

[75] Inventors: Atsushi Saito, Yokohama; Yutaka Koizumi, Tokyo; Toshihiro Mori, Hiratsuka; Minoru Nozawa, Atsugi, all of Japan

[73] Assignee: Canon Kabushiki Kaisha, Tokyo, Japan

[21] Appl. No.: 774,369

[22] Filed: Oct. 10, 1991

Related U.S. Application Data

[63] Continuation of Ser. No. 496,105, Mar. 16, 1990, abandoned, which is a continuation of Ser. No. 175,352, Mar. 30, 1988, abandoned.

[30] Foreign Application Priority Data

Apr. 3, 1987 [JP] Japan ..... 62-81130

[51] Int. Cl.[5] ..... B41J 2/175

[52] U.S. Cl. ..... 346/140 R; 251/65

[58] Field of Search ..... 346/140 R; 251/65

[56] References Cited

U.S. PATENT DOCUMENTS

| | | | |
|---|---|---|---|
| 3,360,007 | 12/1967 | Haidek | 251/65 X |
| 3,407,827 | 10/1968 | Follett | 251/65 X |
| 3,473,529 | 10/1969 | Wallace | 251/65 X |
| 3,675,171 | 7/1972 | Kirk | 251/65 X |
| 3,852,773 | 12/1984 | Sicking et al. . | |
| 4,382,449 | 5/1983 | Nelson | 251/65 X |
| 4,419,678 | 12/1983 | Kasugayama et al. | 346/140 R |
| 4,471,364 | 9/1984 | Kocot | 346/140 |
| 4,586,058 | 4/1986 | Yamazaki et al. . | |
| 4,628,333 | 12/1986 | Terasawa | 346/140 |
| 4,709,249 | 11/1987 | Hanagata | 346/140 |
| 4,737,801 | 4/1986 | Ichihashi et al. . | |
| 4,785,314 | 11/1988 | Terasawa | 346/140 |

FOREIGN PATENT DOCUMENTS

| | | |
|---|---|---|
| 0143213 | 9/1984 | European Pat. Off. . |
| 2315151 | 10/1974 | Fed. Rep. of Germany . |
| 3430142 | 3/1985 | Fed. Rep. of Germany . |
| 3624817 | 2/1987 | Fed. Rep. of Germany . |
| 744858 | 2/1956 | United Kingdom . |

*Primary Examiner*—Joseph W. Hartary

*Attorney, Agent, or Firm*—Fitzpatrick, Cella, Harper & Scinto

[57] ABSTRACT

This specification discloses an ink cartridge provided with a recording liquid containing portion containing recording liquid therein, a supply port for directing the recording liquid in the recording liquid containing portion therethrough to the outside, a vent path for communicating the recording liquid containing portion with the atmosphere, and an opening-closing member having a magnetic member for opening and closing the vent path. A liquid injection recording apparatus, includes a magnetic imparting member for imparting a magnetic force for operating the opening-closing member. The magnetic force is imparted to the opening-closing member through movement of a carriage to thereby effect opening-closing of the vent port.

17 Claims, 5 Drawing Sheets

INK TANK HAVING A VENT PATH OPENED AND CLOSED BY A MOVABLE MAGNETIC MEMBER

This application is a continuation of application Ser. No. 07/496,105 filed Mar. 16, 1990, now abandoned, which was a continuation of application Ser. No. 07/175,352 filed Mar. 30, 1988, now abandoned.

BACKGROUND OF THE INVENTION

1. Field of the Invention

This invention relates to an ink tank for supplying recording liquid carried in a liquid injection recording apparatus, and to a liquid injection recording apparatus provided with a carriage carrying a scanning recording head and the ink tank.

2. Related Background Art

Many of liquid injection recording apparatus of this type are of a form in which, as shown in U.S. Pat. No. 4,447,820, a removably mountable cartridge type tank for recording liquid is mounted in the body of the apparatus, and as such tank (hereinafter simply referred to the ink cartridge), use has generally been made of a flexible bag having recording liquid hermetically sealed therein and contained in a housing having a vent port. That is, the ink cartridge of the construction as described above has often been used to achieve the purpose of preventing evaporation of the hermetically sealed recording liquid and the purpose of keeping the recording liquid under the same degree of pressure as the atmospheric pressure for smooth supply of the recording liquid.

However, in the thus constructed ink cartridge, the construction of the bag is complicated and costly and moreover, the bag which is flexible is unexpectedly susceptible to vibration and shock, and this has sometimes adversely affected the containment and supply of the recording liquid. So, there has been proposed an ink cartridge of simple construction and low cost which instead of a flexible sealed bag and contains recording liquid directly in a housing. In order that the supply of recording liquid may be accomplished smoothly, such an ink cartridge has been provided with a vent port or provided with atmosphere-communicating means for keeping the recording liquid at the atmospheric pressure for example, by inserting into the ink cartridge a hollow needle connected to a tube communicating with the atmosphere.

Further, in such an ink cartridge, in order to prevent the recording liquid from evaporating through the atmosphere-communicating means, it has been proposed to provide as the atmosphere-communicating means an electro-magnetic valve adapted to be opened when the main switch for recording is closed, or a valve adapted to be opened and closed by a pressure difference. It has also been proposed to minimize the size of the vent port to thereby prevent evaporation of the recording liquid.

However, using an electromagnetic valve or the like to open and close the communication between the atmosphere and the recording liquid requires a large-scale construction and a high cost, and the provision of a valve adapted to be opened and closed by a pressure difference has led to the disadvantage that the opening-closing of the valve can be affected by a change in the ambient temperature or the like. Also, making the vent port smaller has led to the disadvantage that the vent port is liable to be readily clogged by dust such as paper powder and becomes unable to fully perform its function as an atmosphere-communicating means. Further, such a cartridge has also suffered from the disadvantage that the recording liquid is generally liable to spill through the atmosphere-communicating means and thereby contaminate the surroundings.

SUMMARY OF THE INVENTION

It is an abject of the present invention to provide an inexpensive ink cartridge which is of very simple structure and which can open and close the communication path with the atmosphere and can directly contain recording liquid and to provide a liquid injection recording apparatus in which during a pause in recording, the vent port of said cartridge is closed to thereby prevent evaporation of the recording liquid and no great cost is required for the opening-closing of the vent port.

To achieve such object, the present invention is characterized in that in a liquid injection recording apparatus wherein a carriage is moved along a platen from the home position as a non-recording area and recording liquid is injected from a recording head carried on the carriage to thereby accomplish recording and supply of the recording liquid is effected by an ink cartridge, opening-closing means for opening and closing a vent path communicating with the atmosphere and the recording liquid containing portion of the ink cartridge is provided in the vent path and atmosphere-communicating means is provided for operating said opening-closing means when the carriage is directed to the home position, thereby closing the vent path.

In the liquid injection recording apparatus according to the present invention, when the carriage is returned to the home position as during the pause of recording, a magnetic member as the opening-closing means provided in association with the vent path of the ink cartridge is subjected to attraction or repulsion by the magnetic force of a magnet as magnetic force imparting means and is thereby moved to close the vent path, whereby the recording liquid can be prevented from evaporating. Also, when the carriage is moved away from the home position as during recording, the influence of the magnet becomes null and the magnetic member is moved to its original position as by gravity to open the vent path and the recording liquid containing portion of the ink cartridge communicates with the atmosphere, whereby smooth supply of the recording liquid can be accomplished.

Or, in the liquid injection recording apparatus according to the present invention, when the carriage is moved to the recording area, the vent path of the ink cartridge can be opened by the magnetic force of the magnet, and when the carriage is moved away from the recording area, the influence of the magnet becomes null, whereby the vent path can be closed.

DESCRIPTION OF THE PREFERRED EMBODIMENTS

Some embodiments of the present invention will hereinafter be described in detail and specifically with reference to the drawings.

Figure 1A:
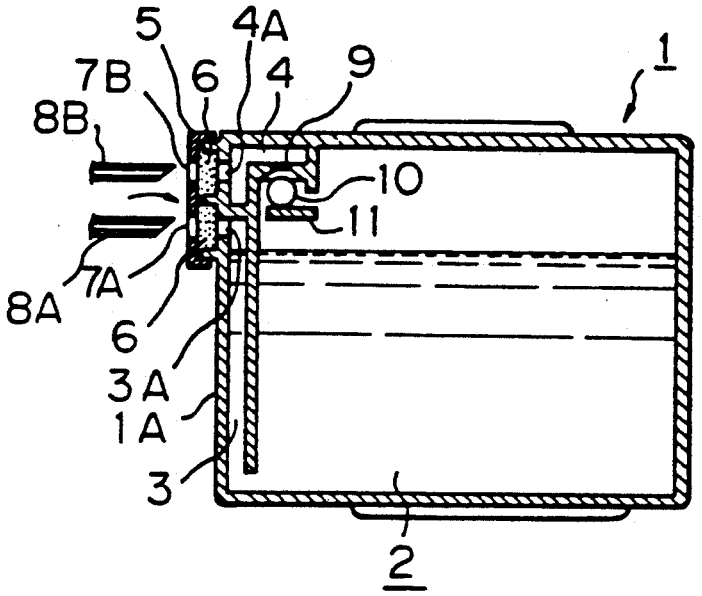
FIGS. 1A and 1B are a schematic cross-sectional view and a schematic side view, respectively, showing an example of the construction of an ink cartridge according to the present invention.
Figure 1B:
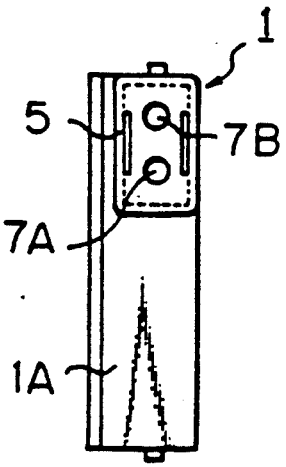

FIGS. 1A and 1B show an example of the construction of an ink cartridge suitable for carrying out the present invention. The ink cartridge 1, as shown in FIG. 1A, has a supply path 3 branching off from a recording liquid containing portion 2, and an air path 4 formed above the recording liquid containing portion 2. A supply port 3A is formed in the upper portion of the supply path 3, and an air port 4A is formed in a cartridge shell 1A in the air path 4. The reference numeral 5 designates a cover member mounted in such a manner as to cover the outer sides of the supply port 3A and air port 4A, and the reference numeral 6 denotes a sealing elastic member as a seal member of silicone rubber, butyl rubber or like material held by the cover member 5 and covering the outer sides of the supply port 3A and air port 4A.

The cover member 5 has insertion ports 7A and 7B at locations therein opposed to the supply port 3A and the air port 4A, respectively, and during the use of the ink cartridge 1, a needle tube 8A for directing recording liquid to a recording head, not shown, and a needle tube 6B communicating with the atmosphere are inserted into the insertion ports 7A and 7B, respectively, and are further caused to pass through the elastic member 6 into the supply port 3A and the air port 4A, respectively, whereby the interior of the ink cartridge becomes equal to the atmospheric pressure and thus, a recording liquid supply state can be brought about.

In FIG. 1A, the recording liquid does not reach the upper portion of the supply path 3, but since the recording liquid is made continuous to the recording head as by sucking the recording liquid by means such as a pump, not shown, through the needle tube 8A, the recording liquid can be continuously supplied as it is consumed.

Further, in FIG. 1A, the reference numeral 9 designates a communication port communicating between the air path 4 and the recording liquid containing portion 2, the reference numeral 10 denotes a ball member as opening-closing means, and the reference numeral 11 designates a ball member receiver provided below the ball 10. The ball member 10, as shown in FIGS. 2A and 2B, has a ball 10A of a magnetic material such as iron, cobalt or nickel at the center thereof and a concentric covering member 10B of a high molecular material such as rubber or synthetic resin, specifically, polyethylene, polypropylene or polyacetal surrounding the ball 10A, and by the covering member 10B, the hermetically sealing capability is enhanced and further, rusting of the ball 10A of a magnetic material can be prevented.

Figure 2A:
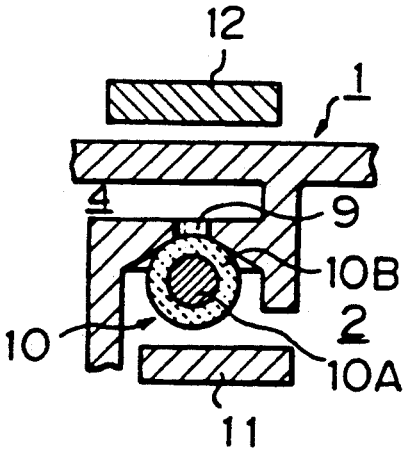
FIGS. 2A and 2B are schematic cross-sectional views showing opening-closing means provided by a ball member disposed in the vent path of the ink cartridge as it is in its closing state and its opening state, respectively.
Figure 2B:
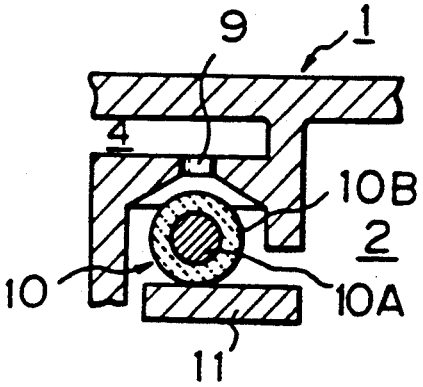

Thus, the ball member 10 is held between the communication port 9 and the ball member receiver 11 with a play around it, and when, as shown in FIG. 2A, a magnet 12, which comprises magnetic force imparting means, becomes proximate to the ink cartridge 1, the ball member 10 is subjected to the attraction by the magnetic force thereof to close the communication port 9. When there is no such proximity of the magnet piece 12, the ball member 10 returns onto the ball member receiver 11 from gravity as shown in FIG. 2B, thereby opening the communication port 9. Atmosphere-communicating means is constructed in this manner. The ink cartridge further communicates with an atmosphere-communicating tube having an opening in the upper portion of the ink cartridge through the needle tube 8B.

The ink cartridge in the embodiment as described above, when removed from the recording apparatus, has its communication with the atmosphere reliably cut off by the elastic member 6, and even when it is mounted in the recording apparatus, the ball member within the ink cartridge can cut off the communication with the atmosphere.

Figure 3A:
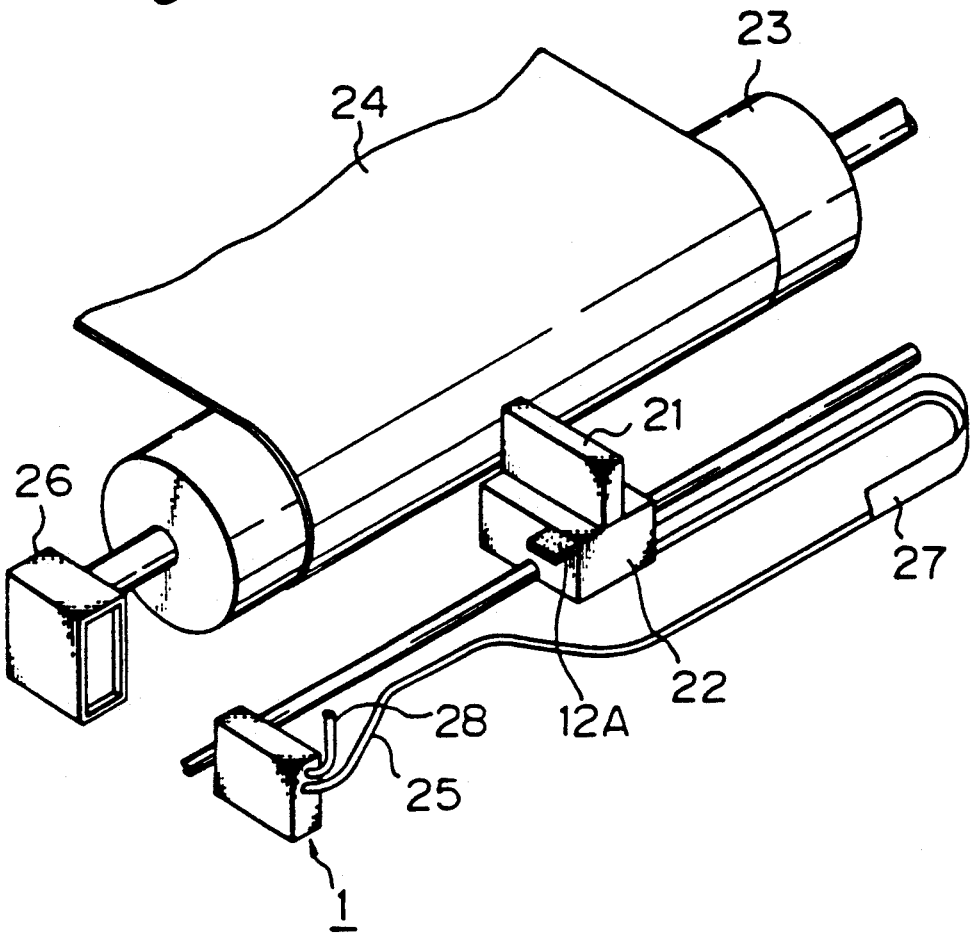
FIGS. 3A is a schematic perspective view showing an example of the construction of a liquid injection recording apparatus according to the present invention.
Figure 3B:
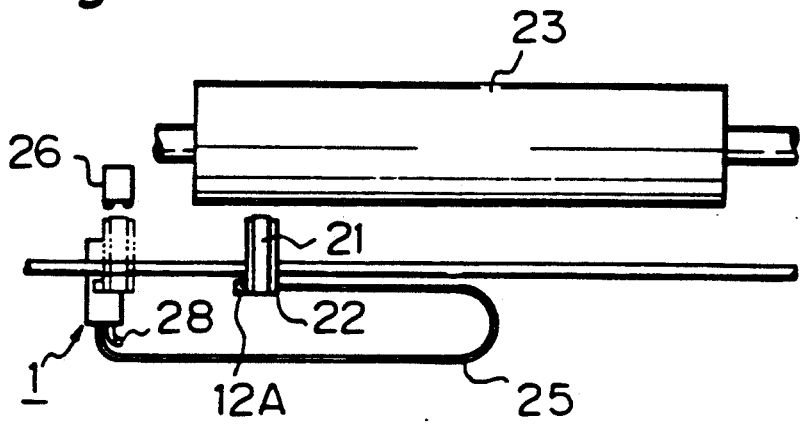
FIG. 3B is a schematic view illustrating the operation thereof.

FIGS. 3A and 3B show a preferred embodiment of the present invention. This embodiment is an example of a liquid injection recording apparatus in which the ink cartridge 1 of the construction as described above is fixed near the home position of the body of the recording apparatus. In these figures, the reference numeral 21 designates a recording head which discharges recording liquid by the utilization of heat. The recording head 21 is carried on a carriage 22, and injects the liquid onto a recording sheet 24 to accomplish recording while being moved along a platen 23 by drive means, not shown. The recording liquid was supplied from the ink cartridge 1 to the recording head 21 through a flexible supply tube 25. A magnet piece 12A is mounted on one end of the carriage 22. When the carriage 22 is directed to the home position at the left end as shown, the magnet piece 12A is guided to the upper portion of the ink cartridge 1 as shown in FIG. 3B, whereupon by the magnetic force thereof, the ball member 10 clases the communication port 9 provided in the air path 4 of the ink cartridge 1, in the manner previously shown in FIG. 2A, whereby the evaporation of the recording liquid through an atmosphere-communicating tube 28 can be prevented. In these figures, the reference numeral 26 designates a cap member for restoring the injecting function of an ink discharge port which is disposed at a position opposed to the recording head 21 in its home position, and the reference numeral 27 denotes a flexible cable.

Figure 4A:
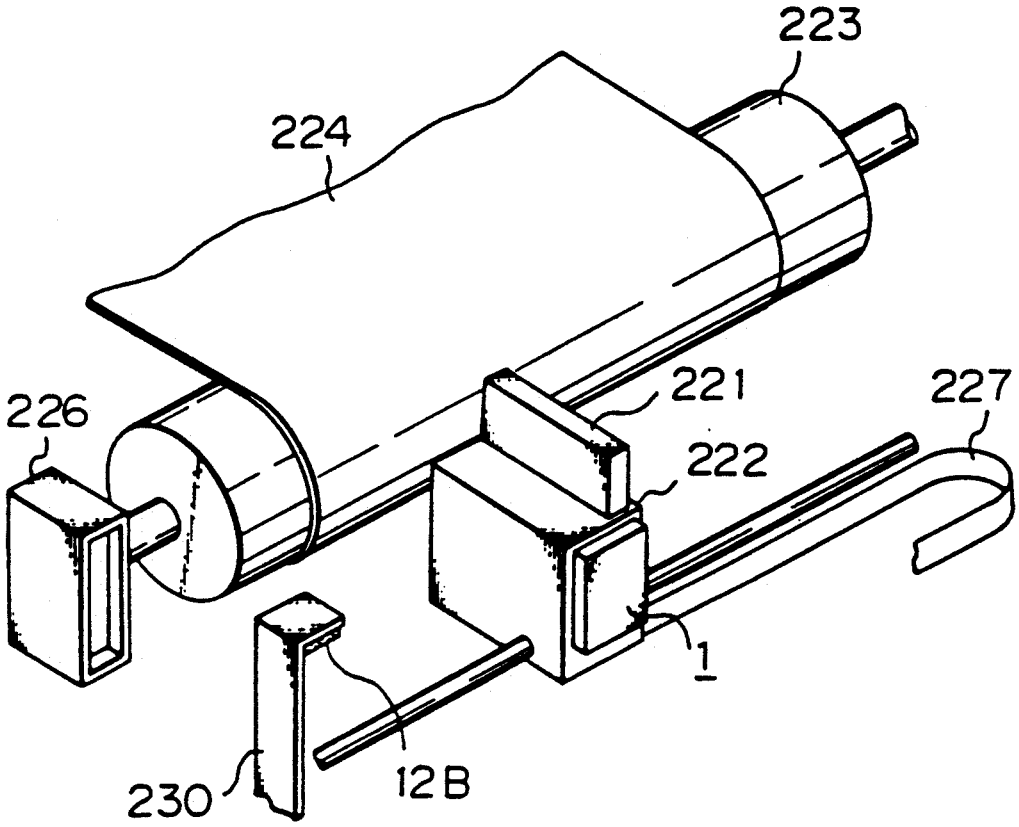
FIG. 4A is a schematic perspective view showing the construction of a liquid injection recording apparatus according to another embodiment of the present invention.
Figure 4B:
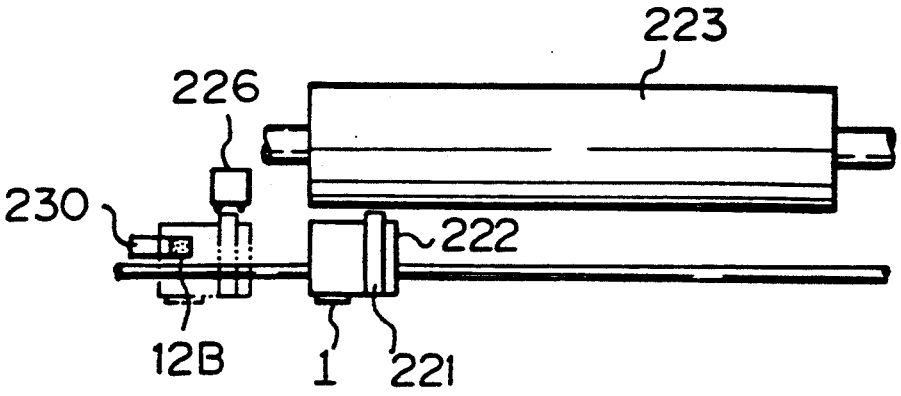
FIG. 4B is a schematic view illustrating the operation thereof.

FIGS. 4A and 4B show another preferred embodiment of the present invention. This embodiment is an example of a liquid injection recording apparatus in which an ink cartridge 1, together with a recording head 221, is carried on a carriage 222. A magnet piece 12B is attached to an upright frame 230 disposed near the home position. When, as shown in FIG. 4B, the carriage 222 is guided to the home position, the ink cartridge 1 carried on the carriage 222 is guided to below the magnet piece 12B, and the communication port 9 shown in FIG. 2A is closed by the ball member 10.

Figure 5A:
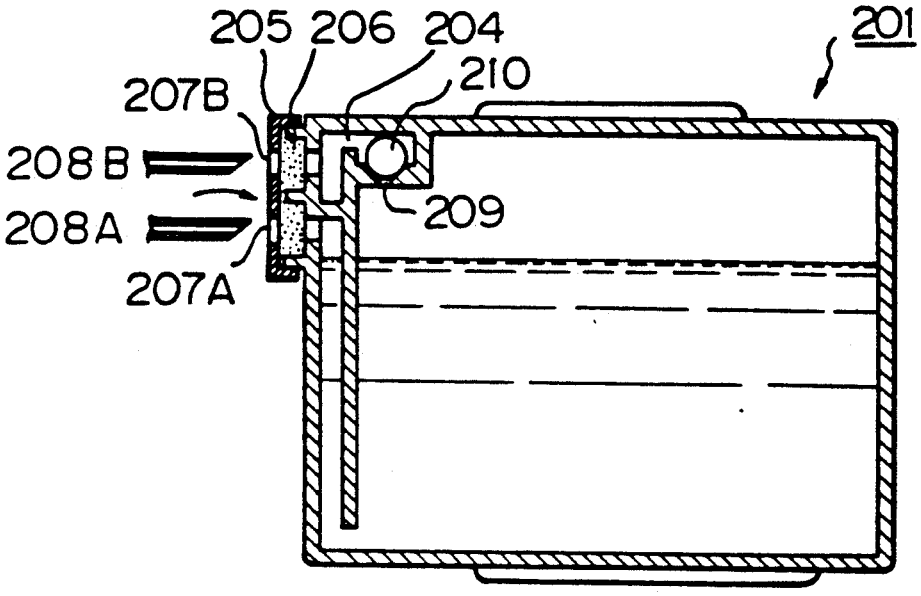
FIGS. 5A and 5B are a schematic cross-sectional view and a schematic side view, respectively, showing the construction of an ink cartridge according to still another embodiment of the present invention.
Figure 5B:
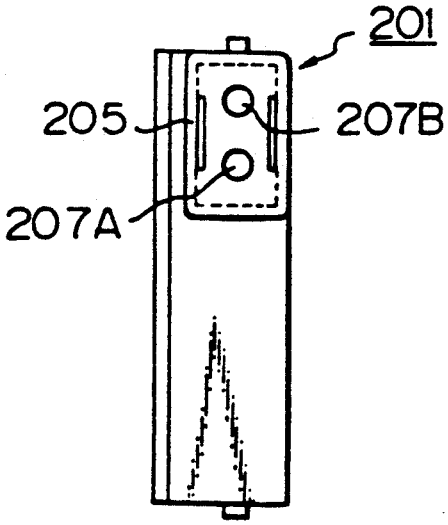

FIGS. 5A and 5B show another embodiment of the ink cartridge suitable for carrying out the present invention.

The ink cartridge 201 of the present embodiment differs somewhat in the opening-closing operation from the form of the ink cartridge shown in FIGS. 1A and 1B. That is, the ink cartridge of the present embodiment is of a construction in which a ball member 210 formed of a magnetic material is disposed in a conical depression provided on top of a communication port 209 in an air path 204. In the other points, the construction of the ink cartridge 201 is identical to that of the ink cartridge shown in FIGS. 1A and 1B. The reference numeral 205 designates a cover member, the reference numeral 206 denotes a sealing elastic member, the reference character 207A designates an insertion port into which a needle tube 208A for recording liquid supply may be inserted, and the reference character 207B denotes an insertion port for a needle tube 208B communicating with the atmosphere.

The communication port 209 of the ink cartridge is normally closed by the force of gravity on the ball member 210, but when subjected to a magnetic force by magnetic force generating means (not shown), the ball member 210 moves upwardly to open the communication port 209.

Thus, the ink cartridge 201 of the present embodiment can cut off the communication with the atmosphere when it is not subjected to a magnetic force.

Figure 6A:
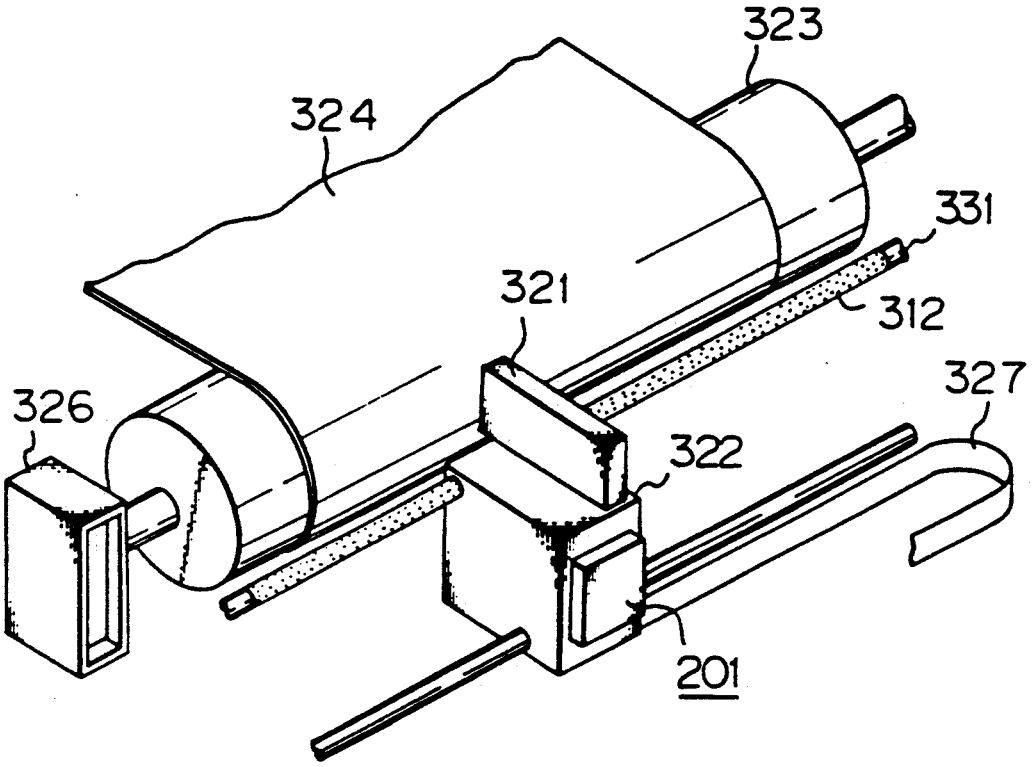
FIG. 6A is a schematic perspective view showing the construction of a liquid injection recording apparatus according to yet still another embodiment of the present invention.
Figure 6B:
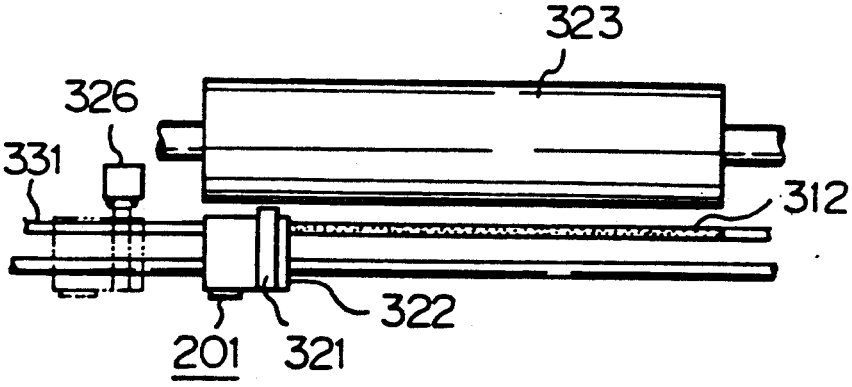
FIG. 6B is a schematic view illustrating the operation thereof.

FIGS. 6A and 6B show still another preferred embodiment of the present invention.

This embodiment is an example of an ink jet recording apparatus in which an ink cartridge of the construction as shown in FIGS. 5A and 5B, together with a recording head 321, is carried on a carriage 322.

The reference numeral 331 designates a shaft for guiding the movement of the carriage 322, and the recording area of this shaft (for example, the position opposed to a platen 323) is provided by a magnet 321.

So, when, as shown in FIG. 6B, the carriage 322 is moved to the recording area, the ball member in the ink cartridge 201 is subjected to an upward attraction by the magnet 321 to thereby open the communication port.

According to the present embodiment, only when the carriage is within the recording area, the recording liquid in the ink cartridge communicates with the atmosphere and therefore, the evaporation of the recording liquid can be reliably prevented during the pause of recording.

In the foregoing, a discription has been provided with respect to a case where the relative position of the magnet piece 12 and the magnetic ball member 10 in the cartridge 1 is in the vertical direction, whereas the direction is not limited to the vertical direction, but for example, the magnet may be disposed in an oblique direction so that the ball member 10 may roll by the magnetic force of the magnet to close the communication port formed in an oblique direction.

Further, in the embodiments described above, design is made such that the attraction generated by the magnet moves the ball member to thereby close the communication port, but a similar operation could be performed even if design were made such that the closing of the communication port is accomplished by the movement of the ball member caused by the repulsion generated by a magnet. Also, the opening-closing means may be of any form in which the opening-closing means is smoothly subjected to attraction or repulsion by a magnet to thereby close the communication port, and may be, for example, a plate-like valve member having one end fixed and capable of opening and closing the communication port, or a conical valve member having a tapered portion insertable into the communication port; However, when cost and the like are taken into account, the ball member as in the present embodiment is more preferable.

Also, the communication port can be opened and closed by a magnetic member and therefore, it has become unnecessary to employ a form of cartridge tank in which recording liquid enclosed in a bag is contained in a case as in the prior art, and vibration resistance and shock resistance can be improved and the whole configuration can be made compact. Also, it has become possible to prevent the evaporation of the recording liquid without resorting to a complex construction which uses an electromagentic valve or the like, and the improved reliability of the cartridge tank can be achieved.

Further, when the cartridge is in its home position, it is possible to reliably close the vent path of the ink cartridge which is in communication with the atmosphere and therefore, leakage of ink from the vent port can be prevented even when the entire recording apparatus is moved during the pause of recording with the ink cartridge remaining carried thereon.

According to the present invention, in the vent path communicating with the recording liquid containing portion of the cartridge tank, there is disposed a magnetic member as opening-closing means capable of opening and closing the vent path and there is also disposed magnetic force imparting means for causing a magnetic force to act on the magnetic member, and the communication with the atmosphere can be cut off by the magnetic member when the carriage is directed outside of the recording area, for example, to the home position. Accordingly, in the ink cartridge and the liquid injection recording apparatus according to the present invention, during a pause in recording, the recording liquid can be prevented from evaporating and can be preserved in a good condition, and during the recording operation, stable supply of the recording liquid could be effected to ensure good recording is accomplished.

In addition according to the present invention, there is provided a simple construction which is resistant to any change in the environment and any external shock and in which an excellent ink cartridge capable of communicating with the atmosphere as required can be manufactured at a low cost.

What is claimed is:

1. In combination, an ink cartridge mountable on an ink jet apparatus, said apparatus including a carriage for carrying said ink cartridge in a recording area and a non-recording area, said ink cartridge comprising:

an ink containing portion for containing ink therein;

a supply port for directing the ink in said ink containing portion outside said ink containing portion;

a vent path for communicating the interior of said ink containing portion with the atmosphere; and open-closing means including a movable magnetic member disposed inside said ink containing portion for opening and closing said vent path, wherein said apparatus further includes magnetic force imparting means for imparting a magnetic force for operating said opening-closing means, wherein the magnetic force is imparted to said opening-closing means by movement of said ink cartridge by said carriage into one of the recording area and the non-recording area to thereby effect one of opening and closing of communication between the interior of said ink containing portion and the atmosphere and the magnetic force is terminated to said opening-closing means by movement of said ink cartridge by said carriage into the other of the recording area and the non-recording area to thereby effect the other of opening and closing of communication between the interior of said ink containing portion and the atmosphere.

2. An ink cartridge according to claim 1, wherein said opening-closing means is a ball member.

3. An ink cartridge according to claim 1, wherein said opening-closing means includes a high-molecular material covering said magnetic member.

4. An ink cartridge according to claim 1, further comprising a sealing member for sealing said supply port.

5. An ink cartridge according to claim 1, further comprising a sealing member for sealing said vent path.

6. A combination according to claim 1, wherein said opening-closing means is freely movable when the magnetic force is not imparted thereto.

7. An ink jet recording apparatus comprising:

a recording head having discharge ports for discharging ink therethrough;

a carriage carrying said recording head thereon and movable in a scanning direction, said carriage carrying said recording head in a recording area and a non-recording area;

an ink tank for containing therein the ink to be supplied to said recording head;

opening-closing means disposed inside said ink tank and having a magnetic member for opening and closing communication between the interior of said ink tank and the atmosphere; and magnetic force imparting means for imparting a magnetic force for operating said opening-closing means, wherein the magnetic force is imparted to said opening-closing means by movement of said recording head by said carriage into one of the recording area and the non-recording area to thereby effect one of opening and closing of communication between the interior of said ink tank and the atmosphere and the magnetic force is terminated to said opening-closing means by movement of said recording head by said carriage into the other of the recording area and the non-recording area to thereby effect the other of opening and closing of communication between the interior of said ink tank and the atmosphere.

8. An ink jet recording apparatus according to claim 7, wherein said ink tank is carried on said carriage and said magnetic force imparting means is disposed in association with the home position of said carriage.

9. An ink jet recording apparatus according to claim 7, wherein said recording head discharges the ink by the utilization of heat.

10. An ink jet recording apparatus according to claim 7, wherein said opening-closing means is a ball member.

11. An ink jet recording apparatus according to claim 7, wherein said opening-closing means comprises a high molecular material covering a magnetic member.

12. An ink jet recording apparatus according to claim 7, further comprising a sealing member for sealing a supply port.

13. An ink jet recording apparatus according to claim 7, further comprising a sealing member for sealing a vent path.

14. An ink jet recording head according to claim 7, wherein said opening-closing means is freely movable when the magnetic force is not imparted thereto.

15. An apparatus according to claim 7, wherein a home position of said carriage is in the non-recording area.

16. An ink jet recording apparatus comprising:

a recording head having discharge ports for discharging ink therethrough;

a carriage carrying said recording head thereon and movable in a scanning direction;

an ink tank for containing therein the ink to be supplied to said recording head;

opening-closing means disposed inside said ink tank and having a magnetic member for opening and closing communication between the interior of said ink tank and the atmosphere; and magnetic force imparting means for imparting a magnetic force for operating said opening-closing means, wherein the magnetic force is imparted to said opening-closing means by movement of said carriage to thereby effect opening and closing of communication between the interior of said ink tank and the atmosphere, said ink tank being disposed in association with the home position of said carriage and said magnetic force imparting means being disposed on said carriage.

17. An ink jet recording apparatus comprising:

a recording head having discharge ports for discharging ink therethrough;

a carriage carrying said recording head thereon and movable in a scanning direction;

an ink tank for containing therein the ink to be supplied to said recording head;

opening-closing means disposed inside said ink tank and having a magnetic member for opening and closing communication between the interior of said ink tank and the atmosphere; and magnetic force imparting means for imparting a magnetic force for operating said opening-closing means, wherein the magnetic force is imparted to said opening-closing means by movement of said carriage to thereby effect opening and closing of communication between the interior of said ink tank and the atmosphere, said ink tank being carried on said carriage and said magnetic force imparting means being disposed in association with a recording area along the scanning direction of said carriage.

* * * * *

UNITED STATES PATENT AND TRADEMARK OFFICE

CERTIFICATE OF CORRECTION

PATENT NO. : 5,221,936 Page 1 of 2

DATED : June 22, 1993

INVENTOR(S) : Atsushi SAITO, et al.

It is certified that error appears in the above-indentified patent and that said Letters Patent is hereby corrected as shown below:

Title page,

AT [56] REFERENCES CITED - U.S. PATENT DOCUMENTS:

"4,737,801 4/1986 Ichihashi et al." should read --4,737,801 4/1988 Ichihashi et al.--.

Title page,

AT [56] REFERENCES CITED - FOREIGN PATENT DOCUMENTS:

"0143213 9/1984 European Pat. Off." should read --0143213 6/1985 European Pat. Off.--.

Title page,

AT [57] ABSTRACT:

Line 2, "This specification discloses an ink cartridge" should read --An ink cartridge is--;

Line 11, "magnetic" should read --magnetic force--.

COLUMN 1:

Line 40, "and" should be deleted.

COLUMN 4:

Line 46, "clases" should read --closes--.

UNITED STATES PATENT AND TRADEMARK OFFICE

CERTIFICATE OF CORRECTION

PATENT NO. : 5,221,936 Page 2 of 2

DATED : June 22, 1993

INVENTOR(S) : Atsushi SAITO, et al.

It is certified that error appears in the above-indentified patent and that said Letters Patent is hereby corrected as shown below:

COLUMN 6:

Line 7, "port;" should read --port.--;

Line 44, "could" should read --can--;

Line 46, "addition" should read --addition,--.

Signed and Sealed this

Fifth Day of April, 1994

Bruce Lehman

BRUCE LEHMAN

*Commissioner of Patents and Trademarks*

*Attest:*

*Attesting Officer*